US010946432B2

(12) United States Patent
Turner et al.

(10) Patent No.: US 10,946,432 B2
(45) Date of Patent: Mar. 16, 2021

(54) METHOD AND APPARATUS FOR FORMING A BEADED CAN END

(71) Applicant: Alfons Haar, Inc., Springboro, OH (US)

(72) Inventors: Stephen B. Turner, Dayton, OH (US); Shawn P. Finley, Springboro, OH (US)

(73) Assignee: Alfons Haar, Inc., Springboro, OH (US)

( * ) Notice: Subject to any disclaimer, the term of this patent is extended or adjusted under 35 U.S.C. 154(b) by 592 days.

(21) Appl. No.: 15/825,154

(22) Filed: Nov. 29, 2017

(65) Prior Publication Data

US 2019/0160517 A1 May 30, 2019

(51) Int. Cl.

| | |
|---|---|
| ***B21D 51/38*** | (2006.01) |
| ***B21D 22/06*** | (2006.01) |
| ***B21D 13/02*** | (2006.01) |
| ***B21D 22/24*** | (2006.01) |
| ***B21D 51/44*** | (2006.01) |

(Continued)

(52) U.S. Cl.

CPC ..... *B21D 51/38* (2013.01); *B21D 13/02* (2013.01); *B21D 22/06* (2013.01); *B21D 22/24* (2013.01); *B21D 51/44* (2013.01); *B65D 17/08* (2013.01); *B65D 1/16* (2013.01)

(58) Field of Classification Search

CPC ..... B21D 51/38; B21D 51/44; B21D 22/24; B21D 22/06; B21D 13/02

See application file for complete search history.

(56) References Cited

U.S. PATENT DOCUMENTS 3,252,315 A * 5/1966 Muench ..... B21D 53/32 72/328

3,868,919 A 3/1975 Schrecker (Continued)

FOREIGN PATENT DOCUMENTS

CN 1476359 A 2/2004

CO 6450608 A2 5/2012

(Continued)

OTHER PUBLICATIONS

First Office Action; Chinese Patent Application No. 2018800034930; dated Feb. 26, 2020; China National Intellectual Property Office; Beijing, China.

(Continued)

*Primary Examiner* — Teresa M Ekiert

(74) *Attorney, Agent, or Firm* — Stevens & Showalter LLP

(57) ABSTRACT

A method and apparatus for forming a can end in a forming press including positioning a sheet of material between an upper punch assembly and a fixed base assembly; cutting a can end blank from the sheet of material; clamping a peripheral portion of the can end blank; moving the upper punch assembly to clamp a central portion of the can end blank between an upper panel punch and a lower panel punch to define a central panel section positioned below an annular inner bead die located adjacent to the lower panel punch on the fixed base assembly; and extending the upper punch assembly to form an initial annular countersink radius next to the peripheral portion of the can end blank, with a substantially undeformed intermediate area extending between the initial annular countersink radius and the annular inner bead die.

19 Claims, 5 Drawing Sheets

(51) Int. Cl.
*B65D 17/00* (2006.01)
*B65D 1/16* (2006.01)

(56) References Cited

U.S. PATENT DOCUMENTS

| | | | | | |
|---|---|---|---|---|---|
| 3,871,314 | A | | 3/1975 | Stargell | |
| 4,955,223 | A | | 9/1990 | Stodd et al. | |
| 5,187,966 | A | * | 2/1993 | Seconde | B21D 22/26 72/329 |
| 5,381,683 | A | * | 1/1995 | Cowling | B21D 51/44 72/329 |
| 5,823,040 | A | * | 10/1998 | Stodd | B21D 51/38 72/329 |
| 5,857,374 | A | | 1/1999 | Stodd | |
| 6,079,249 | A | | 6/2000 | Turner et al. | |
| 6,658,911 | B2 | * | 12/2003 | McClung | B21D 51/38 72/336 |
| 6,702,538 | B1 | * | 3/2004 | Heinicke | B21D 51/38 413/56 |
| 8,573,020 | B2 | | 11/2013 | Stodd | |
| 8,684,211 | B1 | | 4/2014 | Stammen | |
| 9,527,127 | B2 | | 12/2016 | Turner | |
| 9,550,604 | B2 | | 1/2017 | Burleson, Jr. et al. | |
| 2003/0010785 | A1 | | 1/2003 | Stodd | |
| 2005/0199627 | A1 | | 9/2005 | Heinicke | |
| 2016/0228938 | A1 | | 8/2016 | Noe | |

FOREIGN PATENT DOCUMENTS

| | | | |
|---|---|---|---|
| CO | 7600668 | A2 | 5/2016 |
| EP | 518613 | B1 | 1/1996 |
| EP | 1126939 | B1 | 2/2004 |
| GB | 2235641 | A | 3/1991 |
| JP | S60-193834 | A | 10/1985 |
| JP | H05-177284 | A | 7/1993 |
| JP | H05-305360 | A | 11/1993 |
| JP | 2002-528274 | A | 9/2002 |
| KR | 20010099770 | A | 11/2001 |

OTHER PUBLICATIONS

Waei Fujita; Notice of Reasons for Rejection; Japanese Patent Application No. 2019-506670; dated Feb. 19, 2020; Japanese Patent Office; Tokyo, Japan.

Faux, Paul; International Search Report and the Written Opinion of the International Searching Authority; International Application No. PCT/US2018/042855; dated Nov. 7, 2018; European Patent Office; Rijswijk, Netherlands.

Vargas, Daniel Fernando Pulido; Office Action; Columbian Patent Application No. 20190001506; dated May 18, 2020; Columbian Patent and Trademark Office; Bogota, Columbia.

Notice of Preliminary Rejection; Korean Patent Application No. 10-2019-7006187; dated Mar. 26, 2020; Korean Intellectual Property Office; Republic of Korea.

* cited by examiner

METHOD AND APPARATUS FOR FORMING A BEADED CAN END

FIELD OF THE INVENTION

The present invention relates to a manufacturing method and apparatus for forming metallic can ends, and more particularly to a method and apparatus for forming can ends with little or no stretching, and with minimal thinning of material during formation of the can end.

BACKGROUND OF THE INVENTION

Metallic beverage can ends are designed to have one or more stiffening beads extending around the can end adjacent the circumference or periphery of the can end. These beads are typically defined by interconnected bead radii and bead valley radii alternating with one another in a radial direction of the can end. The beads are formed inward from a countersink radius, or chuckwall radius, and can be located outward from a central panel portion of the can end.

Beverage can bodies and can ends must be sufficiently strong to withstand high internal pressures and also external forces resulting from shipment and handling. Additionally, they must be manufactured from extremely thin and durable materials to reduce costs of manufacturing and weight of the finished products. These seemingly incompatible requirements of high strength and light weight can be accomplished by aggressively working the thin materials using interacting male and female tool combinations. Unfortunately, aggressive material working can lead to inconsistencies within a given contour or geometry of can ends due to excessive stretching or thinning of material from which the can ends are made. Such inconsistencies resulting during formation may diminish strength and alter other characteristics of the can ends.

In the present application, techniques for controlling stretching and thinning in formed portions of can ends are illustrated in methods and apparatus for forming can ends from thin stock that exhibit required strength and possess improved consistency.

SUMMARY OF THE INVENTION

In accordance with an aspect of the invention, a method for forming a can end in a forming press is provided. The method comprises positioning a sheet of material between an upper punch assembly and a fixed base assembly in the forming press; cutting a can end blank from the sheet of material; clamping a peripheral portion of the can end blank; moving the upper punch assembly from a retracted position toward an extended position, and clamping a central portion of the can end blank between an upper panel punch and a lower panel punch to define a central panel section on the can end blank, wherein the central panel section is below an annular inner bead die located adjacent to the lower panel punch on the fixed base assembly; and extending the upper punch assembly subsequent to clamping the central portion of the can end blank to form an initial annular countersink radius next to the peripheral portion of the can end blank, with a substantially undeformed intermediate area extending between the initial annular countersink radius and the annular inner bead die.

The upper punch assembly may be extended to engage an annular first intermediate bead punch against the can end blank and a first intermediate bead valley radius may be initially formed in the intermediate area of the can end blank, and the depth of the countersink radius may be simultaneously increased.

The upper punch assembly may be further extended to engage an annular second intermediate bead punch against the can end blank and initially form a second intermediate bead valley radius in the intermediate area of the can end blank, wherein the depth of the first intermediate bead valley radius and the countersink radius may be simultaneously increased.

Forming the initial annular countersink radius may comprise engaging the can end blank with an outer bead punch on the upper punch assembly after an initial engagement of the upper panel punch against the can end blank.

Initial formation of the annular countersink radius may include upward displacement of the upper panel punch relative to the outer bead punch while the upper panel punch clamps the central panel section to the lower panel punch.

The peripheral portion of the can end blank may be clamped on a crown ring of the fixed base assembly, and the outer bead punch may cooperate with an inner wall of the crown ring to form a generally vertical outer wall of the countersink radius.

The upper punch assembly may include an annular outer bead punch, an annular middle bead punch, and an annular inner bead punch, and the fixed base assembly may include an annular outer bead die, an annular middle bead die, and the annular inner bead die, and wherein, subsequent to an initial engagement of the outer bead punch on the can end blank: the undeformed intermediate area of the can end blank may extend in engagement with the outer bead die, the middle bead die and the inner bead die; and the middle bead punch and the inner bead punch may be located spaced from the can end blank.

The middle bead punch may engage the can end blank prior to an engagement of the inner bead punch on the can end blank.

The outer bead punch and the inner bead punch may extend downward farther than the middle bead punch.

Movement of the upper punch assembly to its extended position may complete formation of the can end blank into a can end having a countersink radius, a middle bead valley radius, and an inner bead valley radius, wherein the central panel section may remain clamped between the upper panel punch and the lower panel punch during the entire formation of the beads.

In accordance with another aspect of the invention, a method for forming a can end in a forming press is provided. The method comprises positioning a sheet of material between an upper punch assembly and a fixed base assembly in the forming press; cutting a can end blank from the sheet of material; clamping a peripheral portion of the can end blank between a crown ring and a knockout ring; providing an upper punch assembly having a plurality annular bead punches and an upper panel punch supported for movement relative to the bead punches; providing a fixed base assembly having a plurality of annular bead dies for cooperating with the bead punches and a lower panel punch; moving the upper punch assembly from a retracted position toward an extended position. In addition, movement of the upper punch assembly comprises: engaging a central portion of the can end blank with the upper panel punch prior to engagement of the can end blank with the bead punches or the bead dies; and subsequently moving the upper punch assembly to clamp the central portion of the can end blank between the upper panel punch and the lower panel punch with the can end blank engaged with a single one of the bead punches and a single one of the bead dies.

The upper punch assembly may be extended subsequent to clamping the central portion of the can end such that the single one of the bead punches moves the can end blank down into engagement with one or more of the remaining bead dies.

Subsequent to the can end blank moving into engagement with the one or more of the remaining bead dies, further movement of the upper punch assembly may move the remaining bead punches into engagement with the can end blank.

The single one of the bead punches may comprise a radially outermost bead punch and the single one of the bead dies may comprise a radially innermost bead die.

A substantially undeformed intermediate area may extend between the outermost bead punch and the innermost bead die.

The lower panel punch may be immovably fixed relative to the bead dies.

In accordance with a further aspect of the invention, an apparatus is provided for forming a can end from a sheet of material in a single acting press having a fixed base assembly and a movable upper punch assembly. The apparatus comprises a crown ring rigidly supported on the fixed base assembly and having an upper surface defining a contour for a crown of the can end. A knockout ring is carried by the upper punch assembly, the knockout ring being aligned with the crown ring for engaging a workpiece upon movement of the upper punch assembly toward the fixed base assembly to form a crown in a peripheral portion of the workpiece. A plurality of annular bead punches are supported on the upper punch assembly and an upper panel punch is fluidly supported on the upper punch assembly for movement relative to the bead punches. A plurality of annular bead dies and a lower panel punch are supported on the fixed base assembly for cooperating with the bead punches and the upper panel punch, respectively. Movement of the upper punch assembly from a retracted position toward an extended position engages the workpiece between the crown ring and the knockout ring, and positions the upper panel punch in engagement with the workpiece prior to engagement of the workpiece with the bead punches or the bead dies. Subsequent movement of the upper punch assembly clamps the workpiece between the upper panel punch and the lower panel punch with the workpiece engaged with a single one of the bead punches and a single one of the bead dies.

The upper panel punch may displace into the upper punch assembly during movement of the punch assembly toward the extended position subsequent to clamping the workpiece between the upper panel punch and the lower panel punch.

The plurality of bead punches on the upper punch assembly may be supported in fixed relation to each other and the upper panel punch may be movable relative to the plurality of bead punches.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

The present application discloses methods and apparatus for forming panels, shells, or can ends so that formed portions of the can ends have controlled thinning to substantially prevent warping, twisting and/or fractures that may occur if thinning is uncontrolled. In accordance with an aspect of the disclosed methods and apparatus, the formed portions of the can ends can be produced with no stretching, or negligible stretching, of the material during the forming process.

Figure 1:
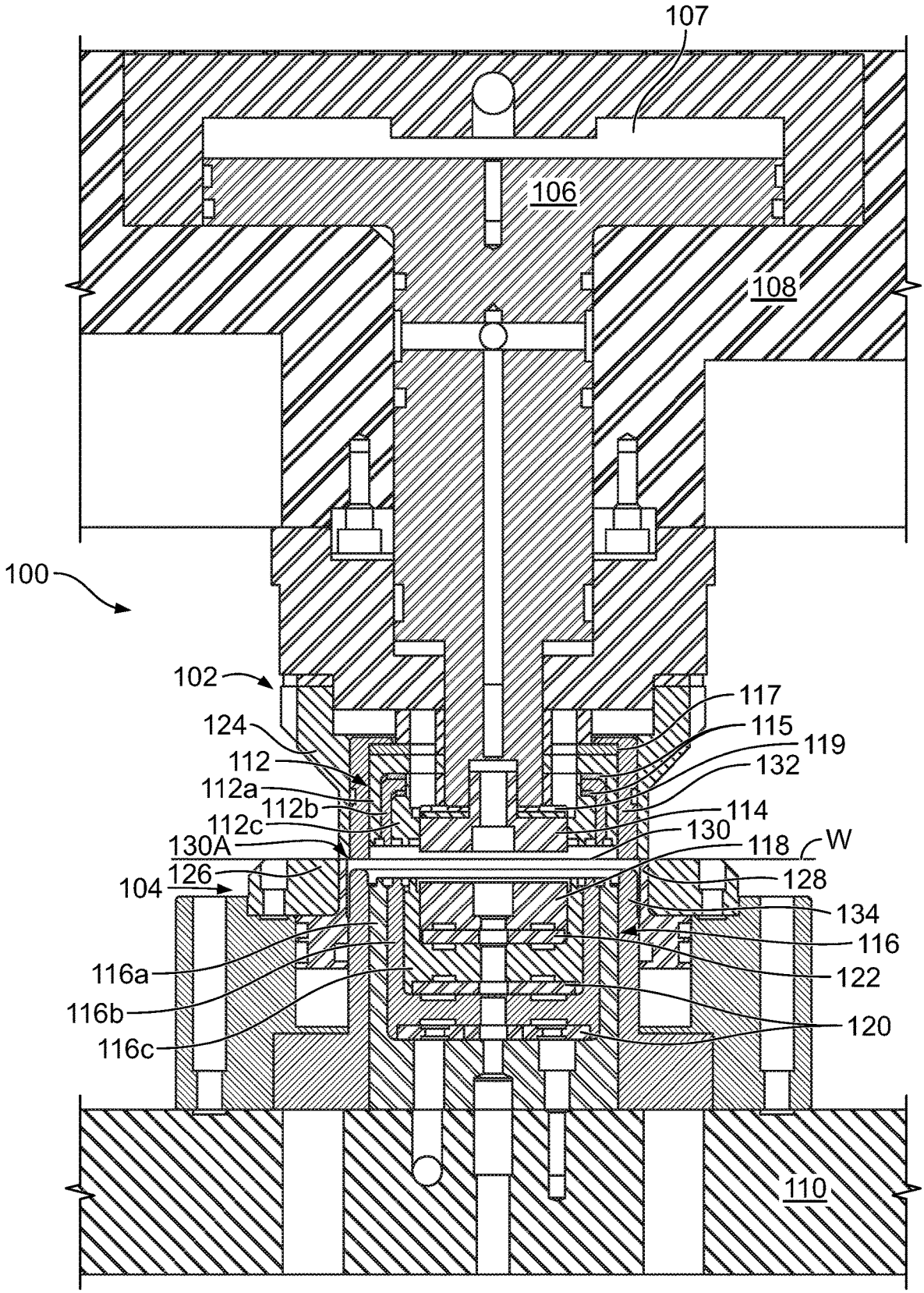
FIG. 1 is a schematic sectional view showing a forming press operable in accordance with aspects of the present description illustrating an upper punch assembly of the forming press in a lowered position at the initiation of a blank forming process for forming a can end.

Reference is now made to FIG. 1 which illustrates a forming press 100 having a movable upper punch assembly 102 and a lower fixed base assembly 104. The upper punch assembly 102 is movable between a retracted position spaced from the fixed base assembly 104 and an extended position adjacent to the fixed base assembly 104 at a bottom dead center position of the forming press 100. The upper punch assembly 102 includes a punch piston 106 mounted in an upper die shoe 108, and the lower fixed base assembly 104 includes a lower die shoe 110.

A bead punch assembly 112 is secured in fixed relation to the upper die shoe 108 and includes an annular outer bead punch 112*a*, an annular middle bead punch (first intermediate bead punch) 112*b*, and an annular inner bead punch (second intermediate bead punch) 112*c*. Punch bead spacers 115 may be provided to enable positioning of the middle bead punch 112*b* and inner bead punch 112*c* relative to each other and relative to the outer bead punch 112*a*. Further, an additional bead punch spacer 117 may be provided above the outer bead punch 112*a* to enable positioning the outer, middle, and inner bead punches 112*a*, 112*b*, 112*c* relative to the upper die shoe 108. Alternatively, the bead punch assembly 112 may comprise the outer bead punch 112*a*, middle bead punch 112*b*, and inner bead punch 112*c* formed integrally, i.e., as a single unit, with the positions of the bead punches 112*a*, 112*b*, 112*c* fixed relative to each other.

The upper punch assembly 102 further includes an upper panel punch 114 that is secured to the punch piston 106 and supported for movement relative to the bead punch assembly 112. One or more spacers 119 may be provided between the punch piston 106 and the upper panel punch 114 to adjust the vertical position of the upper panel punch 114 within the upper die shoe 108. In the illustrated configuration, two spacers 119 of different diameter are illustrated wherein the thickness of one or both of the spacers 119 may be ground to adjust the vertical position of the upper panel punch 114. In an alternative configuration, a single spacer having a stepped diameter could be provided in place of the two spacers 119 illustrated herein. In the illustrated embodiment, the inner bead punch 112*c* may be located at the same height or slightly above the outer bead punch 112*a*, and the middle bead punch 112*b* may be located at a height above both the outer and inner bead punches 112*a*, 112*c*, see FIG. 3.

The lower fixed base assembly 104 includes a lower bead die assembly 116 for cooperating with the bead punch assembly 112 during a forming process performed on a workpiece or blank 130 which is cut from a sheet of material in the forming press. The bead die assembly 116 comprises an annular outer bead die 116*a*, an annular middle bead die 116*b*, and an annular inner bead die 116*c*. Additionally, the lower bead die assembly 116 includes a lower panel punch 118 for cooperating with the upper panel punch 114.

Die spacers 120 can be provided to position the middle bead die 116*b* and inner bead die 116*c* relative to each other and relative to the outer bead die 116*a*, and a lower panel punch spacer 122 can be provided to position the lower panel punch relative to the inner bead die 116*c*. Alternatively, the lower bead die assembly 116 may comprise the outer bead die 116*a*, middle bead die 116*b*, inner bead die 112*c*, and lower panel punch 118 formed integrally, i.e., as a single unit, with the positions of the bead dies 116*a*, 116*b*, 116*c* fixed relative to each other and fixed relative to the lower die assembly 116.

As seen in FIG. 1, an upper surface of the lower panel punch 118 is located at an elevation or height that is below the height of the inner bead die 116*c*. Further, in the illustrated embodiment, the middle bead die 116*b* may be located at a greater height than the inner bead die 116*c*, and the outer bead die 116*a* may be located at a greater height than the middle bead die 116*b*. It should be understood that the heights of the bead punches 112*a*, 112*b*, 112*c* and bead dies 116*a*, 116*b*, 116*c* relative to each other are selected to provide a sequential forming of beads for the can end that facilitate formation of the can end with no or limited stretching of the blank material, as will be described further below.

Figure 2:
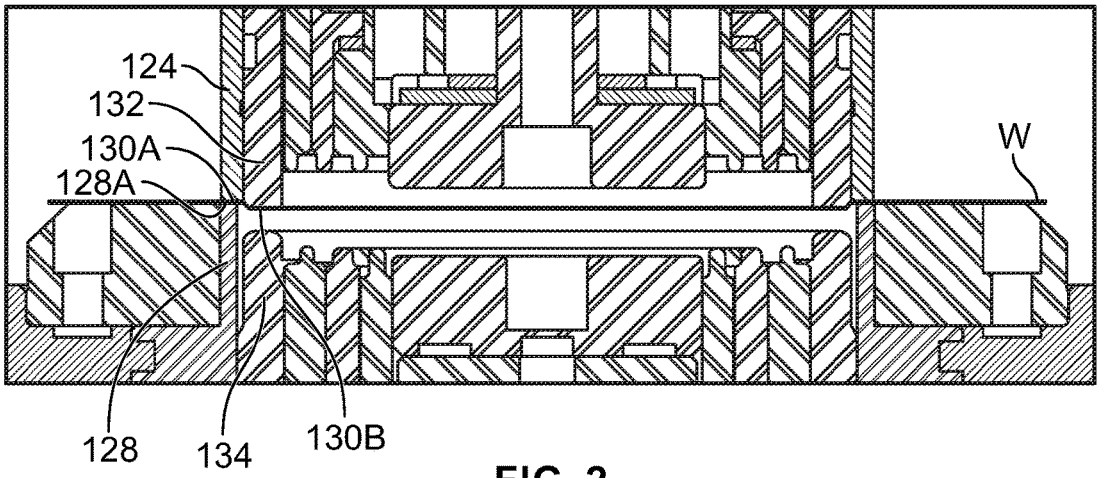
FIG. 2 is an enlarged schematic sectional view of the forming press of FIG. 1 immediately following clamping of a workpiece between a draw punch and draw pad in preparation for a blanking operation.

As shown in FIG. 1, the upper punch assembly 102 is moved from the retracted position toward the extended position, and is located adjacent to the fixed base assembly 104 to cut a can end blank 130 from the sheet or workpiece W. The can end blank 130 is cut from the sheet or workpiece W by a blank or draw punch 124 carried by the upper punch assembly 102, and a cut edge 126 carried by the fixed base assembly 104. An outer peripheral portion 130A of the can end blank 130 is clamped at an outer clamping area 128A between the draw punch 124 and a draw pad 128 movably supported on the fixed base assembly 104 of the forming press 100 so that the can end blank is held in a generally horizontal orientation as shown. A knockout ring 132 carried by the upper punch assembly 102 is engaged against a crown portion 1306 of the blank 130 adjacent to the outer peripheral portion 130A, as can be further seen in FIG. 2.

Figure 3:
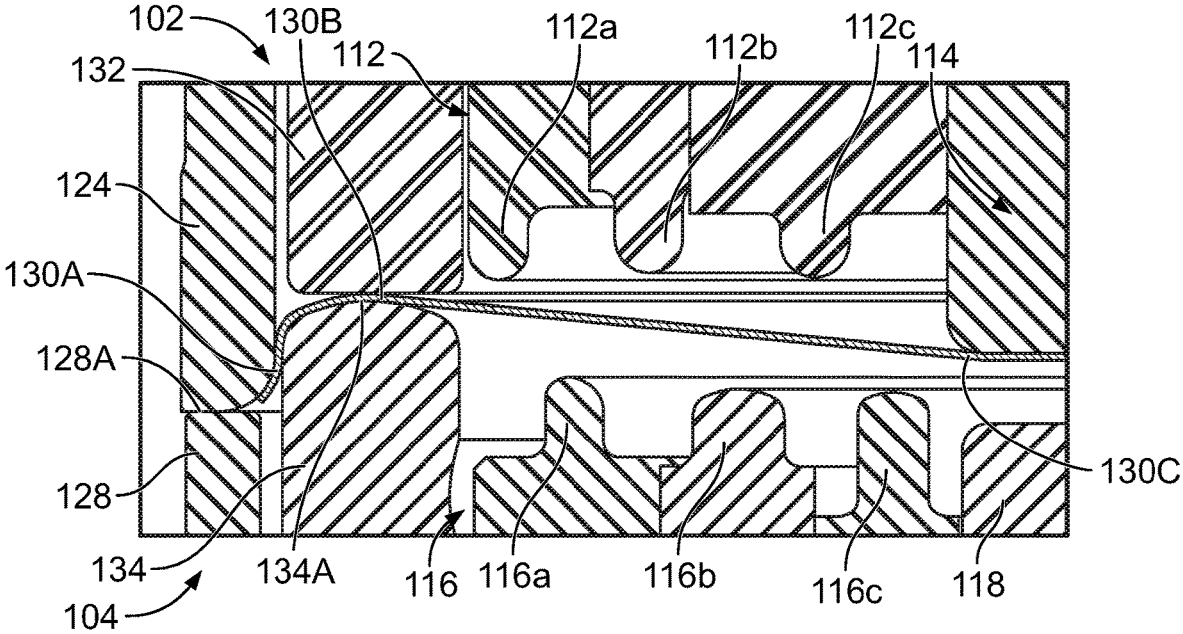
FIG. 3 is an enlarged schematic sectional view showing portions of the forming press of FIG. 1 illustrating clamping engagement of a blank between a knockout ring and a crown ring.

Referring to FIG. 3, during downward movement of the upper punch assembly 102 toward the extended position, the knockout ring 132 moves into association with a crown ring 134 to clamp the crown portion 130B at a crown clamping area 134A between the knockout ring 132 and the crown ring 134. The draw pad 128 is supported in the fixed base assembly 104 on an air cushion.

Further downward movement of the draw punch 124 with the upper punch assembly 102, following clamping at the crown clamping area 134A, moves the outer clamping area 128A down below the crown clamping area 134A, such that the peripheral portion 130A is extracted from the outer clamping area 128A.

At substantially the same time or after the peripheral portion 130A is released from the outer clamping area 128A, the upper panel punch 114 can engage against the center panel portion 130. The crown ring 134 is rigidly supported in the lower fixed base assembly 104 and the knockout ring 132 is spring biased downwardly in the upper punch assembly 102. Hence, the knockout ring 132 can retract into the upper punch assembly 102 following clamping of the crown portion 130B in the crown clamping area 134A and as the upper punch assembly 102 continues to move toward the fixed base assembly 104. Further continued downward movement of the upper punch assembly 102 engages the upper panel punch 114 against a center panel section 131 of the blank 130 to the position shown in FIG. 3.

It may be noted that an air pressure is applied to a chamber 107 above the punch piston 106, see FIG. 1, during the downward stroke of upper punch assembly 102 to bias the upper panel punch 114 downwardly relative to the bead punch assembly 112 throughout the downward stroke of upper punch assembly 102. In the illustrated exemplary embodiment, the upper punch assembly 102 may move downward about 0.295 in. (0.749 cm) between the position shown in FIG. 2 and the position shown in FIG. 3. It may be understood that the particular dimensions identified with reference to movement of the tooling in the steps of the forming process described with reference to FIGS. 2-9 are provided for exemplary purposes only, and are not intended to be limiting to the invention claimed herein. That is, the dimensions of tooling movement are provided to illustrate a relative degree of movement throughout the forming process, and variations in the particular movement or degree of movement of the tooling can be included within the forming process described herein.

Figure 4:
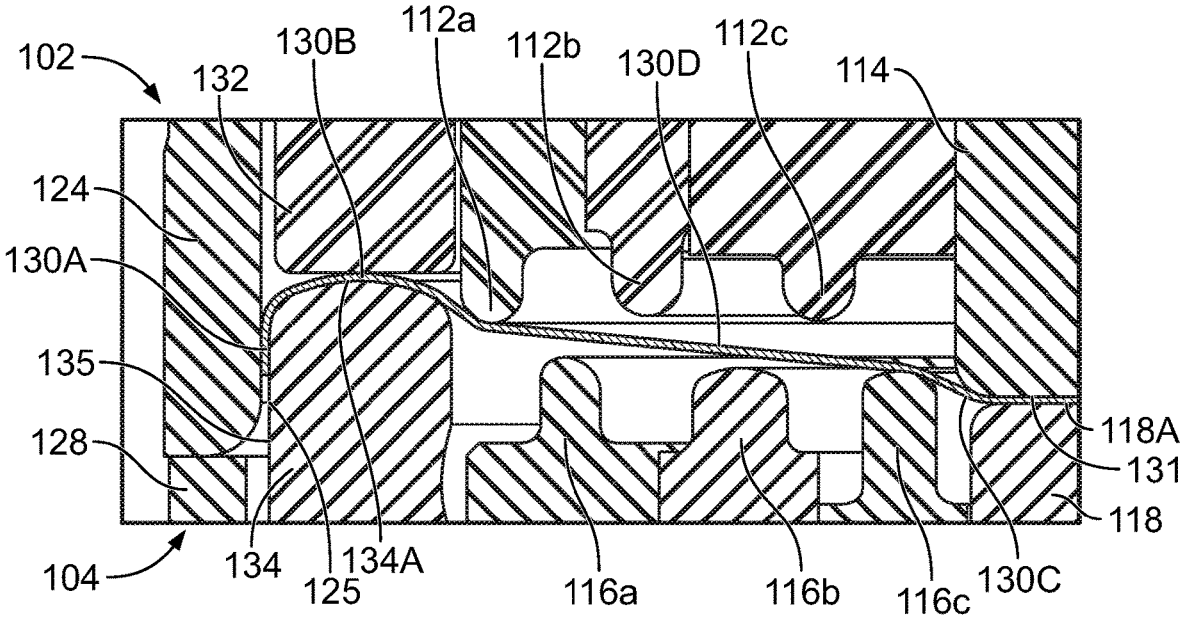
FIG. 4 is an enlarged schematic sectional view showing portions of the forming press of FIG. 1 immediately following a clamping engagement of the blank between an upper panel punch and a lower panel punch.

Referring to FIG. 4, during further downward movement of the upper punch assembly 102 toward the extended position, the upper panel punch 114 is positioned to clamp the center panel portion 130C in a panel clamping area 118A between the upper panel punch 114 and the lower panel punch 118 to define a center panel valley portion 130C of the blank 130, which substantially corresponds to the center panel section 131. At generally the same time as the upper panel punch 114 moves into position to define the center panel valley portion 130C, the outer bead punch 112*a* engages the blank 130 adjacent to the crown clamping area 134A to partially form the crown portion 1306 around the upper surface of the crown ring 134 and draw a portion 130A of the outer peripheral portion around the crown ring 134.

Additionally, as a lower surface of the upper panel punch 114 moves below the inner bead die 116*c*, a portion of the blank 130 adjacent to the center panel portion 130C is positioned in engagement over the inner bead die 116*c*. At this stage of the can end formation, an intermediate area 130D of the blank 130 spanning between the upper bead punch 112*a* and the inner bead die 116*c* comprises a substantially undeformed portion of the blank 130 that is out of engagement with the middle and inner bead punches 112*b*, 112*c* and out of engagement with the outer and middle bead dies 116*a*, 116*b*. In the illustrated exemplary embodiment, the upper punch assembly 102 may move downward about 0.067 in. (0.170 cm) between the position shown in FIG. 3 and the position shown in FIG. 4.

Figure 5:
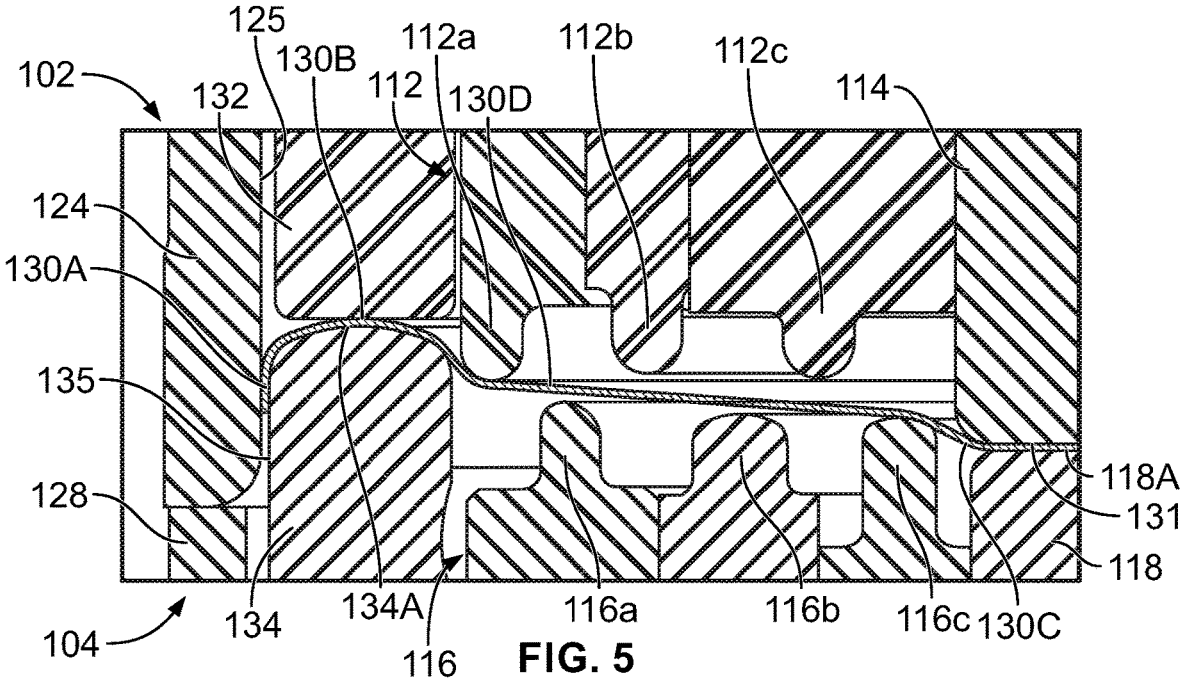
FIG. 5 is an enlarged schematic sectional view showing portions of the forming press of FIG. 1 illustrating an initial step in formation of an outer bead for the can end.

Referring to FIG. 5, during further downward movement of the upper punch assembly 102 toward the extended position, the center panel section 131 remains clamped in the panel clamping area 118A, and the outer bead punch 112*a* continues to press an outer periphery of the intermediate section 130D downward and draw additional material from the outer peripheral portion 130A of the blank 130 around the crown ring 134. As the bead punch assembly 112 moves downward, the upper panel punch 114 is displaced upward relative to the bead punch assembly 112, against the air pressure in the chamber 107. Additionally, the outer bead punch 112*a* can begin a deformation of the material of the blank 130 as an initial step in formation of an annular outer bead for the can end. It may be noted that as material is drawn from the outer peripheral portion 130A, it passes through a die area defined between an inner wall 125 of the draw punch 124 and an outer wall 135 of the crown ring 134 to form a generally vertical outer wall for the can end. In the illustrated exemplary embodiment, the upper punch assembly 102 may move downward about 0.010 in. (0.025 cm) between the position shown in FIG. 4 and the position shown in FIG. 5.

Figure 6:
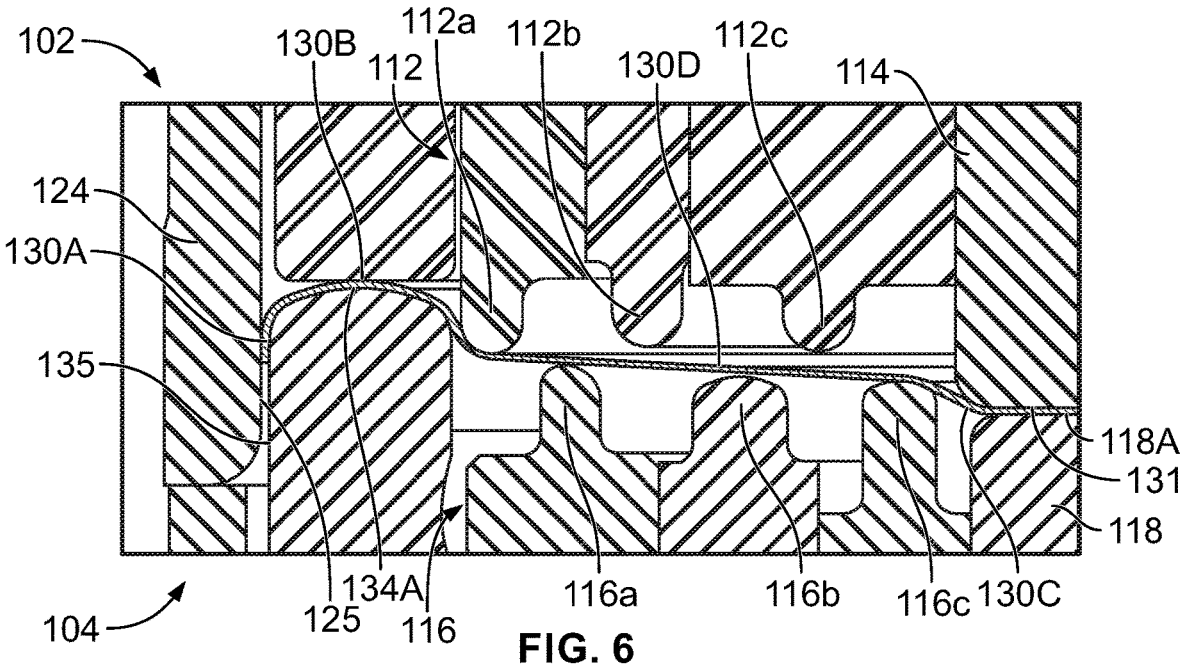
FIG. 6 is an enlarged schematic sectional view showing portions of the forming press of FIG. 1 illustrating a further downward movement of the upper punch assembly positioning the blank adjacent to the upper bead dies.

Referring to FIG. 6, during further downward movement of the upper punch assembly 102 toward the extended position, the center panel section 131 remains clamped in the panel clamping area 118A, and the outer bead punch 112*a* continues to press an outer periphery of the intermediate section 130D downward and draw additional material from the outer peripheral portion 130A of the blank 130 around the crown ring 134. As the bead punch assembly 112 moves downward, the upper panel punch 114 is displaced further upward relative to the bead punch assembly 112, against the air pressure in the chamber 107. The outer bead punch 112*a* moves the intermediate section 130D into contact or closely adjacent to contact with one or both of the outer and middle bead dies 116*a*, 116*b*, while the middle and inner bead punches 112*b*, 112*c* can remain out of contact with the intermediate section 130D. In the illustrated exemplary embodiment, the upper punch assembly 102 may move downward about 0.010 in. (0.025 cm) between the position shown in FIG. 5 and the position shown in FIG. 6.

Figure 7:
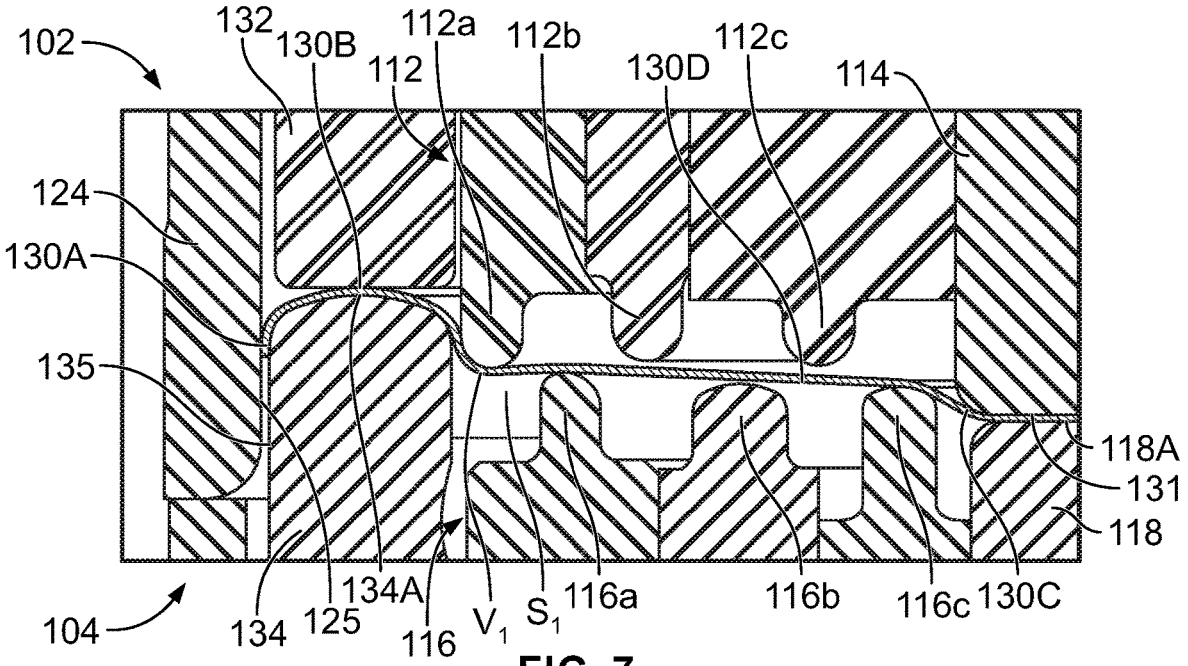
FIG. 7 is an enlarged schematic sectional view showing portions of the forming press of FIG. 1 illustrating a further downward movement of the upper punch assembly to position the blank in engagement with an outer bead die for formation of the outer bead of the can end.

Referring to FIG. 7, during further downward movement of the upper punch assembly 102 toward the extended position, the center panel section 131 remains clamped in the panel clamping area 118A, and the outer bead punch 112*a* continues to press the outer periphery of the intermediate section 130D downward and draw additional material from the outer peripheral portion 130A of the blank 130 around the crown ring 134. As the bead punch assembly 112 continues to move downward, the upper panel punch 114 is displaced further upward relative to the bead punch assembly 112, against the air pressure in the chamber 107. At the stage of formation shown in FIG. 7, the blank 130 can be in engagement with the first bead die 116*a*, and the outer bead punch 112*a* can press the material of the blank 130 into a first die space $S_1$ between the crown ring 134 and the outer bead die 116*a*, past or below the height of the outer bead die 116*a*, to form a countersink radius $V_1$, also referred to as a chuckwall radius. Further, the middle and inner bead punches 112*b*, 112*c* can remain out of contact with the intermediate section 130D as the countersink radius $V_1$ is formed. In the illustrated exemplary embodiment, the upper punch assembly 102 may move downward about 0.010 in. (0.025 cm) between the position shown in FIG. 6 and the position shown in FIG. 7.

Figure 8:
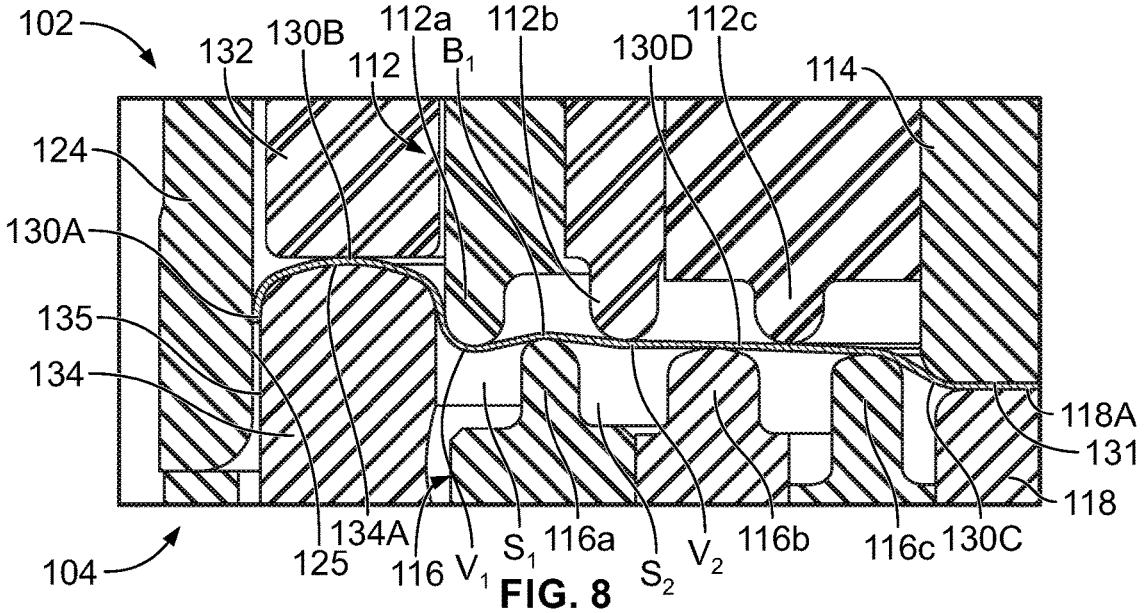
FIG. 8 is an enlarged schematic sectional view showing portions of the forming press of FIG. 1 illustrating a further downward movement of the upper punch assembly to form a middle bead of the can end.

Referring to FIG. 8, during further downward movement of the upper punch assembly 102 toward the extended position, the center panel section 131 remains clamped in the panel clamping area 118A, and the outer bead punch 112*a* continues to press the outer periphery of the intermediate section 130D downward and draw additional material from the outer peripheral portion 130A of the blank 130 around the crown ring 134. As the bead punch assembly 112 continues to move downward, the upper panel punch 114 is displaced further upward relative to the bead punch assembly 112, against the air pressure in the chamber 107. The middle bead punch 112*b* can press the material of the blank 130 into a second die space $S_2$ between the outer bead die 116*a* and the middle bead die 116*b*, past or below the height of the outer bead die 116*a*, to form a first intermediate or middle bead valley radius $V_2$, and further defining a first bead radius $B_1$ separating the first and second valley radii $V_1$, $V_2$. As the second bead valley radius $V_2$ is formed, the downward movement of the outer bead punch 112*a* with the bead punch assembly 112 continues to deepen the countersink radius $V_1$. It may be noted that material of the blank 130 may be drawn radially inward across the outer bead die 116*a*, the outer bead punch 112*a*, and the crown ring 134 with downward movement of the upper bead punch assembly 112 to provide material for forming the beads with little or no stretching of the material of the blank 130. In the illustrated exemplary embodiment, the upper punch assembly 102 may move downward about 0.010 in. (0.025 cm) between the position shown in FIG. 7 and the position shown in FIG. 8.

Figure 9:
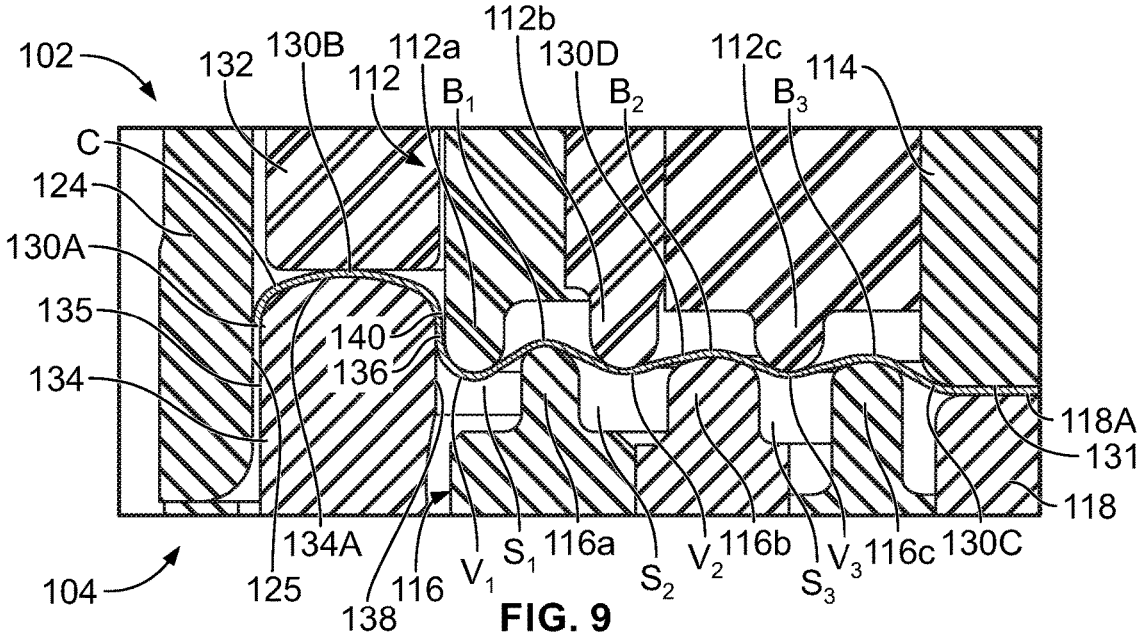
FIG. 9 is an enlarged schematic sectional view showing portions of the forming press of FIG. 1 illustrating a further downward movement of the upper punch assembly to form an inner bead of the can end.

Referring to FIG. 9, during further downward movement of the upper punch assembly 102 toward the extended position, the center panel section 131 remains clamped in the panel clamping area 118A, and the outer bead punch 112*a* continues to press the outer periphery of the intermediate section 130D downward and draw additional material from the outer peripheral portion 130A of the blank 130 around the crown ring 134. As the bead punch assembly 112 continues to move downward, the upper panel punch 114 is displaced further upward relative to the bead punch assembly 112, against the air pressure in the chamber 107. The inner bead punch 112*c* can press the material of the blank 130 into a third die space $S_3$ between the middle bead die 116*b* and the inner bead die 116*c*, past or below the height of the middle bead die 116*b* and the inner bead die 116*c*, to form a second intermediate or inner bead valley radius $V_3$. Forming the inner bead valley radius $V_3$ further coincides with forming a second bead radius $B_2$ separating the middle and inner bead valley radii $V_2$, $V_3$ and forming or completing a third bead radius $B_3$ separating the inner bead valley radius $V_3$ and the center panel valley portion 130C. As the inner bead valley radius $V_3$ is formed, the downward movement of the outer and middle bead punches 112*a*, 112*b* with the bead punch assembly 112 continues to deepen the countersink radius $V_1$ and middle bead valley radius $V_2$. As noted above, the material of the blank 130 may be drawn radially inward as the upper punch assembly 102 moves downward. In particular, the material of the blank 130 may be drawn across the outer and middle bead dies 116*a*, 116*b*, the outer, middle and inner bead punches 112*a*, 112*b*, 112*c*, and the crown ring 134 with downward movement of the upper bead punch assembly 112 to provide material for forming the countersink radius $V_1$, and the middle and inner bead valley radii $V_2$, $V_3$ with little or no stretching of the material of the blank 130.

Figure 10:
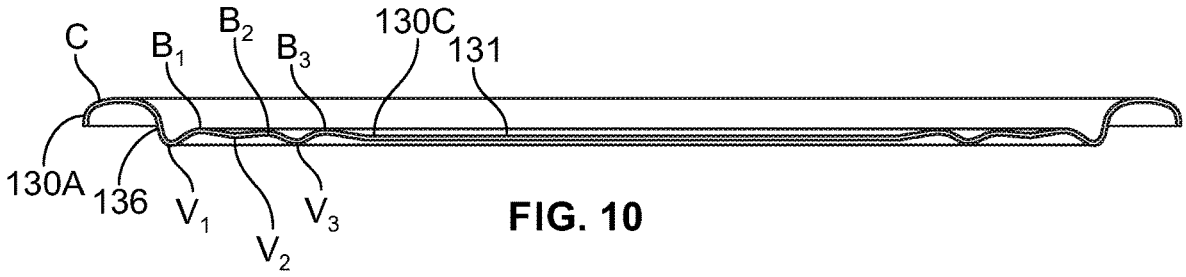
FIG. 10 is a sectional view of an exemplary can end formed in accordance with aspects of the present description.

The forming stage illustrated in FIG. 9 represents downward movement at or close to the extended position of the upper punch assembly 102, and completes the outer peripheral portion 130A of the blank 130 to a final length defining an outer wall of a crown C of the can end. The crown C has a final contour defined by the upper surface of the crown ring 134 and is connected to the countersink radius $V_1$ at a vertical outer countersink wall 136 formed between an inner wall 138 of the crown ring 134 and an outer wall 140 of the outer bead punch 112*a*, as may be further seen in FIG. 10. In the illustrated exemplary embodiment, the upper punch assembly 102 may move downward about 0.031 in. (0.079 cm) between the position shown in FIG. 8 and the position shown in FIG. 9.

It should be understood that although the steps for forming a can end include initiating formation of the middle bead valley radius $V_2$ as a first intermediate bead valley radius following the step of initiating formation of the countersink radius additional aspects of the invention may include a different order of bead valley radius formation. For example, the bead punch assembly 112 and bead die assembly 116 may be configured to initiate formation of the inner bead valley radius $V_3$ as the first intermediate bead valley radius followed by initiating formation of the middle bead valley radius $V_2$ as the second intermediate bead valley radius.

From the above description, it may be understood that the can end is formed with successive formation of valley radii wherein initial formation of the valley radii may be staged to occur at different times in the forming process. In particular, formation of the countersink radius may be initiated first and successive intermediate valley radii may be formed sequentially which, in combination with only providing the upper forming tooling "on air" while the bottom tooling is "on solid" or fixed, results in a reduction in press tonnage required for formation of the can end.

In forming the can end, a bending of the material forming the blank 130 can be performed gradually wherein bending of the material can be accommodated by either pulling additional material from the outer portion 130A of the blank 130 or by a localized thinning of material at the bead radii or valley radii. Performing the forming operation as a sequential draping of the material over the tooling of the bead punch assembly 112 and bead die assembly 116, as is illustrated in FIGS. 2-9, reduces restriction on movement of the material from the outer portion 130A, such that the material of the blank 130 is pulled inward more readily to reduce the amount of thinning that might otherwise occur. Hence, it may be understood that throughout the steps described with reference to FIGS. 2-9, the material for forming the bead valley radii and bead radii, and in particular the material of the intermediate section 130D, is not substantially stretched but rather is formed with relatively small sequential deformations that thin the material a minimal amount to form the beads, while the center panel section 131 remains clamped at a stationary position. For example, the can end formation process described herein may be performed with no more than about 6% material thinning and no or negligible material stretching.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for forming a can end in a forming press, the method comprising:

positioning a sheet of material between an upper punch assembly and a fixed base assembly in the forming press;

cutting a can end blank from the sheet of material;

clamping a peripheral portion of the can end blank;

moving the upper punch assembly from a retracted position toward an extended position, and clamping a central portion of the can end blank between an upper panel punch and a lower panel punch to define a central panel section on the can end blank, wherein the central panel section is below an annular inner bead die located adjacent to the lower panel punch on the fixed base assembly; and extending the upper punch assembly subsequent to clamping the central portion of the can end blank to form an initial annular countersink radius next to the peripheral portion of the can end blank, with a substantially undeformed intermediate area extending between the initial annular countersink radius and the annular inner bead die.

2. The method of forming a can end as set forth in claim 1, including extending the upper punch assembly to engage an annular first intermediate bead punch against the can end blank and initially form a first intermediate bead valley radius in the intermediate area of the can end blank, and simultaneously increasing the depth of the countersink radius.

3. The method of forming a can end as set forth in claim 2, including further extending the upper punch assembly to engage an annular second intermediate bead punch against the can end blank and initially form a second intermediate bead valley radius in the intermediate area of the can end blank, wherein the depth of the first intermediate bead valley radius and the countersink radius is simultaneously increased.

4. The method of forming a can end as set forth in claim 1, wherein forming the initial annular countersink radius comprises engaging the can end blank with an outer bead punch on the upper punch assembly after an initial engagement of the upper panel punch against the can end blank.

5. The method of forming a can end as set forth in claim 4, wherein initial formation of the annular countersink radius includes upward displacement of the upper panel punch relative to the outer bead punch while the upper panel punch clamps the central panel section to the lower panel punch.

6. The method of forming a can end as set forth in claim 4, wherein the peripheral portion of the can end blank is clamped on a crown ring of the fixed base assembly, and the outer bead punch cooperates with an inner wall of the crown ring to form a generally vertical outer wall of the countersink radius.

7. The method of forming a can end as set forth in claim 1, wherein the upper punch assembly includes an annular outer bead punch, an annular middle bead punch, and an annular inner bead punch, and the fixed base assembly includes an annular outer bead die, an annular middle bead die, and the annular inner bead die, and wherein, subsequent to an initial engagement of the outer bead punch on the can end blank:

the undeformed intermediate area of the can end blank extends in engagement with the outer bead die, the middle bead die and the inner bead die; and the middle bead punch and the inner bead punch are located spaced from the can end blank.

8. The method of forming a can end as set forth in claim 7, wherein the middle bead punch engages the can end blank prior to an engagement of the inner bead punch on the can end blank.

9. The method of forming a can end as forth in claim 8, wherein the outer bead punch and the inner bead punch extend downward farther than the middle bead punch.

10. The method of forming a can end as set forth in claim 9, wherein movement of the upper punch assembly to its extended position completes formation of the can end blank into a can end having a countersink radius, a middle bead valley radius, and an inner bead valley radius, wherein the central panel section remains clamped between the upper panel punch and the lower panel punch during the entire formation of the beads.

11. A method for forming a can end in a forming press, the method comprising:

positioning a sheet of material between an upper punch assembly and a fixed base assembly in the forming press;

cutting a can end blank from the sheet of material;

clamping a peripheral portion of the can end blank between a crown ring and a knockout ring;

wherein the upper punch assembly has a plurality annular bead punches and an upper panel punch supported for movement relative to the bead punches;

wherein the fixed base assembly has a plurality of annular bead dies for cooperating with the bead punches and a lower panel punch;

moving the upper punch assembly from a retracted position toward an extended position, wherein movement of the upper punch assembly comprises:

engaging a central portion of the can end blank with the upper panel punch prior to engagement of the can end blank with the bead punches or the bead dies; and subsequently moving the upper punch assembly to clamp the central portion of the can end blank between the upper panel punch and the lower panel punch with the can end blank engaged with a single one of the bead punches and a single one of the bead dies.

12. The method of forming a can end as set forth in claim 11, including extending the upper punch assembly subsequent to clamping the central portion of the can end such that the single one of the bead punches moves the can end blank down into engagement with one or more of the remaining bead dies.

13. The method of forming a can end as set forth in claim 12, wherein, subsequent to the can end blank moving into engagement with the one or more of the remaining bead dies, further movement of the upper punch assembly moves the remaining bead punches into engagement with the can end blank.

14. The method of forming a can end as set forth in claim 11, wherein the single one of the bead punches comprises a radially outermost bead punch and the single one of the bead dies comprises a radially innermost bead die.

15. The method of forming a can end as set forth in claim 14, wherein a substantially undeformed intermediate area extends between the outermost bead punch and the innermost bead die.

16. The method of forming a can end as set forth in claim 11, wherein the lower panel punch is immovably fixed relative to the bead dies.

17. Apparatus for forming a can end from a sheet of material in a single acting press having a fixed base assembly and a movable upper punch assembly, the apparatus comprising:

a crown ring rigidly supported on the fixed base assembly and having an upper surface defining a contour for a crown of the can end;

a knockout ring carried by the upper punch assembly, the knockout ring being aligned with the crown ring for engaging a workpiece upon movement of the upper punch assembly toward the fixed base assembly to form a crown in a peripheral portion of the workpiece;

a plurality annular bead punches supported on the upper punch assembly and an upper panel punch fluidly supported on the upper punch assembly for movement relative to the bead punches;

a plurality of annular bead dies and a lower panel punch supported on the fixed base assembly for cooperating with the bead punches and the upper panel punch, respectively;

wherein movement of the upper punch assembly from a retracted position toward an extended position engages the workpiece between the crown ring and the knockout ring, and positions the upper panel punch in engagement with the workpiece prior to engagement of the workpiece with the bead punches or the bead dies, and subsequent movement of the upper punch assembly clamps the workpiece between the upper panel punch and the lower panel punch with the workpiece engaged with a single one of the bead punches and a single one of the bead dies.

18. The apparatus for forming a can end from a sheet of material in a single acting press as set forth in claim 17, wherein the upper panel punch displaces into the upper punch assembly during movement of the punch assembly toward the extended position subsequent to clamping the workpiece between the upper panel punch and the lower panel punch.

19. The apparatus for forming a can end from a sheet of material in a single acting press as set forth in claim 18, wherein the plurality of bead punches on the upper punch assembly are supported in fixed relation to each other and the upper panel punch is movable relative to the plurality of bead punches.

* * * * *